United States Patent [19]

Allen

[11] Patent Number: 4,622,702

[45] Date of Patent: Nov. 18, 1986

[54] DRAIN PLUNGER

[76] Inventor: Kenneth A. Allen, 3912 Douglas Ave., Racine, Wis. 53402

[21] Appl. No.: 797,225

[22] Filed: Nov. 12, 1985

[51] Int. Cl.[4] ..... E03D 11/00

[52] U.S. Cl. ..... 4/255

[58] Field of Search ..... 4/255–257

[56] References Cited

U.S. PATENT DOCUMENTS

| | | | |
|---|---|---|---|
| 355,806 | 1/1887 | Anson | 4/255 |
| 674,197 | 5/1901 | Cooper | 4/255 |
| 2,496,525 | 2/1950 | Eggleston | 4/255 |
| 2,846,698 | 8/1958 | Tomlinson | 4/255 |
| 3,130,421 | 4/1964 | Quinlan | 4/255 |
| 4,445,236 | 5/1984 | Nadolny et al. | 4/255 |

*Primary Examiner*—Stephen Marcus
*Assistant Examiner*—Linda J. Sholl
*Attorney, Agent, or Firm*—Peter N. Jansson, Ltd.

[57] ABSTRACT

An improved plunger for clearing clogged bathroom drains and the like. The plunger has apertures through the wall of its resiliently collapsible cup and a diaphragm or other occlusion member on the inside surface of the cup for alternately opening and partially occluding the apertures in response to pressures and liquid flow. The invention allows repetitive application of downward hydraulic pressure on the clog without excessive reverse pressures during the intervening upward strokes, facilitates variation in the degree of hydraulic pressure applied, and provides several related advantages. In one preferred embodiment, the diaphragm is secured to a raised portion of the cup inside surface. In another, the degree of maximum occlusion is adjustable by turning the occlusion member. In yet another, the cup and diaphragm are integrally formed.

20 Claims, 6 Drawing Figures

DRAIN PLUNGER

FIELD OF THE INVENTION

This invention is related generally to tools for clearing clogged bathroom drains and the like and, more particularly, to cupped plungers of the type used to apply hydraulic pressure for clearing clogged drains.

BACKGROUND OF THE INVENTION

The conventional plunger, which consists of a resilient collapsible cup attached to the end of a handle, is well known and widely used. The open lower end of the cup is submerged in the water in sealing engagement about a drain and the cup is pumped alternately down and up to create hydraulic pressure on a clog lodged in the drain pipe.

Generally speaking, plungers of the prior art are often too slow and ineffective in achieving the desired result. Despite the fact that many attempts at improvement have been made, there remains a need for a fast-acting, effective plunger which is simple in construction and operation.

The conventional plunger has been modified in a variety of ways to improve the pumping action or for various other reasons. Examples of prior art devices include those disclosed in U.S. Pat. Nos. 4,445,236 (Nadolny et al.), 4,238,860 (Dixon), 3,644,943 (Parodi fu Leonardo et al.), 2,846,698 (Tomlinson), 2,496,525 (Eggleston) and 1,734,206 (Fisch), and British Specification No. 20,066 (Cooper). However, there are practical problems in these and other plungers of the prior art.

The most commonly used plungers have the problem of applying an often unwanted updrawing pressure on the clog between downward clog-clearing strokes of the plunger. When the collapsed cups of such plungers reassume their normal cup-like shapes, excessively negative pressures are created and cause such updrawing.

Plungers of the prior art designed to reduce this undesirable reverse action, including various valved plungers, are too complex in construction and operation. There has been a need for a plunger of simple and reliable construction overcoming this problem.

Another drawback of prior art devices is the difficulty sometimes encountered in controlling the degree of hydraulic pressure to be applied to the clog. Sometimes, when greater manual pressure is applied to the plunger, the water trapped within the collapsing cup in the toilet bowl or other container will burst unexpectedly out of the cup causing agitation in the bowl to such an extent that the typically waste-laden water may splash or spill out. This, of course, is very undesirable.

There is a need for an improved plunger minimizing or avoiding this problem. There is a need for an improved plunger allowing easy variation, particularly increases, in the degree of hydraulic pressure applied to the clog without greatly increasing the risk of uncontrollable water bursts, splashing and spilling. There is a need for an improved plunger having these advantages, and yet being simple and reliable in construction.

BRIEF SUMMARY OF THE INVENTION

This invention is an improved drain plunger for clearing clogged bathroom drains and the like which overcomes certain problems and deficiencies of the prior art, including those mentioned above.

The drain plunger of this invention can repetitively apply a desired amount of hydraulic pressure to a clog without excessive reverse pressure between downstrokes and without excessive agitation of the water. The invention is fast-acting, reliable and effective, and, furthermore, is of simple construction.

The plunger includes the typical resiliently collapsible cup, having a lower lip for sealingly engaging the wall of a bowl around a drain and a wall extending from the lip to an upper end, and a driving handle member attached the the upper end. The cup has a generally concave lower surface. Aperture means, usually including several apertures, are in the cup wall to permit flow of liquid therethrough, and partial occlusion means on the lower surface of the wall regulate the flow of water through the aperture means.

The partial occlusion means, which is preferably a diaphragm secured to the cup at a position adjacent to the aperture or apertures, moves between a seated position partially occluding the aperture means and an unseated position allowing full flow through the aperture means.

The cup wall, which typically has upwardly-extending and radially-extending portions between its lower lip and its upper end, preferably has aperture means through the radially-extending portion. Most preferably, the aperture means is on the upper portion of the cup near the driving handle, which is attached along the axis of the cup.

In some preferred embodiments, the aperture means includes a plurality of apertures, preferably circular holes, arranged around the axis of the cup, along which the handle is aligned. Such apertures may be substantially equidistant from the axis of the cup or may be at varying spacings from the axis. The diaphragm may be secured to the cup at or near the axis and have a free, preferably circular, edge which crosses the apertures such that the edge portion of the diaphragm covers a major portion of the cross-sections of the apertures.

The diaphragm preferably covers substantially equal portions of each of the apertures when the apertures are equidistant from the axis and of equal size. For example, the diaphragm may cover two-thirds or three-quarters of each of the apertures, leaving a minor portion of each aperture unoccluded.

The partial occlusion means, preferably the edge portion of the diaphragm, is movable in response to pressure and liquid flow. During the forceful downward stroke of the inventive plunger, which collapses the plunger cup, the movable edge portion of the diaphragm is seated by virtue of the outward (upward) flow of liquid from the collapsing cup through the aperture(s), even though this flow may be rather limited by the partial occlusion of the aperture(s).

With the aperture(s) partially occluded in this manner, the hydraulic force, which is applied to the clog through the water in the drain as downward manual pressure is applied on the plunger, is substantially maintained. But the fact that the occlusion is partial, rather than complete, allows the release of some pressure to prevent an "explosion" of water from the cup. Since the occlusion is partial, the hydraulic pressure applied to the clog can be increased or otherwise varied with minimal risk of excessive turbulence in the bowl or basin.

When the downward driving force of a downward stroke is released, the resilient cup reassumes its uncollapsed shape, and in doing so creates a negative pressure in the cup with respect to the normal pressure of the water within the bowl or basin. This negative pressure, however, is relieved by virtue of a quick in-flow of water from the water in the basin or bowl in which the plunger cup is submerged.

The negative pressure and resulting in-flow serve to unseat the diaphragm or other partial occlusion member from the aperture(s) which allows the in-flow to be quick and substantial. Since the negative pressure is relieved, the aforementioned undesirable updrawing is minimized and the principal action on the clog becomes the repeated downward hydraulic pressure on it.

The resulting rapid in-flow also serves to "reload" the collapsible cup with water to prepare it for the next downward stroke. As a result, such downward strokes can come in quick succession, and the clog may quickly and effectively be removed.

Preferred embodiments of this invention include a raised portion (hub) on the lower (inside) surface of the cup adjacent to the aperture means. The diaphragm is secured to such raised portion in order to space the free end portions of the diaphragm from the lower surface of the cup. Such spacing eliminates or minimizes any problem of the diaphragm adhering to the inside surface, thus facilitating diaphragm movement.

In another preferred embodiment, the extent of partial occlusion of the aperture(s) is made adjustable by adjustably mounting the diaphragm to the cup. Such adjustment may be by virtue of a rotatable mounting of the diaphragm to the cup.

In one such embodiment, one or more apertures which are unequally spaced about the axis of the plunger, for example, all being within one 180 degree arc, are partially occluded by a circular diaphragm which is eccentrically and rotatably mounted to the cup along the axis of the plunger. Rotation of the diaphragm to differing positions changes the degree of occlusion. Rotational adjustment may be facilitated by a nub or other means on the lower surface of the diaphragm.

OBJECTS OFTHE INVENTION

It is an object of this invention to provide an improved plunger overcoming some of the problems and shortcomings of plungers of the prior art.

Another object of this invention is to provide a plunger which can clear clogged drains more quickly and effectively than many prior art plungers.

Another object of this invention is to provide a plunger having the above advantages, yet being simple in construction and operation.

Another object of this invention is to provide an improved plunger which reduces updrawing between downward-driving strokes.

Still another object of this invention is to provide a plunger in which downward-driving hydraulic force can be applied quickly and effectively without excessive agitation of the water surrounding the plunger.

Yet another object of this invention is to provide a plunger allowing excellent control of the degree of hydraulic clog-clearing pressure next to a drain.

Another object of the invention is to provide an improved plunger which, while having the aforementioned advantages, is simple in construction and operation.

These and other objects will be apparent from the following additional descriptions and from the drawings, in which:

DETAILED DESCRIPTION OF PREFERRED EMBODIMENTS

Figure 1:
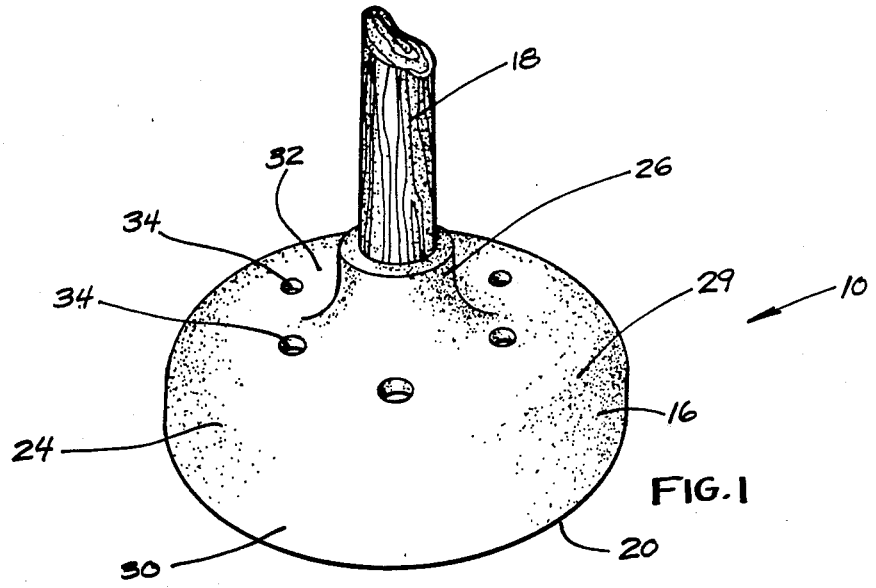
FIG. 1 is a perspective view showing an improved plunger in accordance with this invention.
Figure 2:
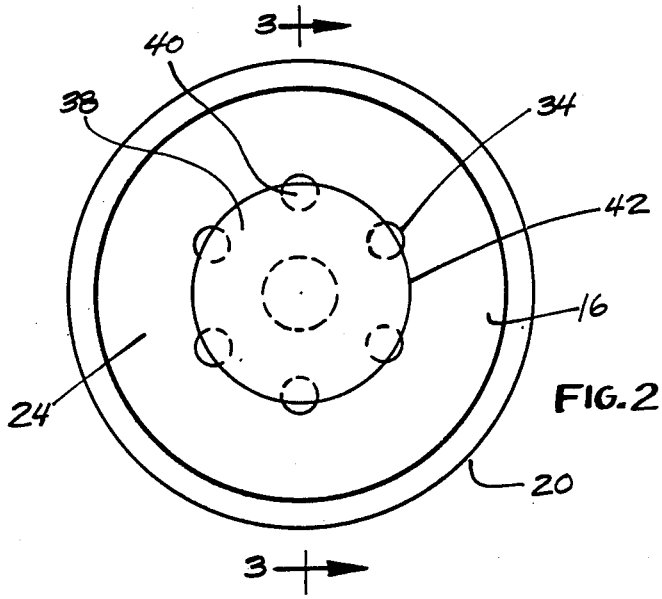
FIG. 2 is a bottom plan view of FIG. 1.
Figure 3:
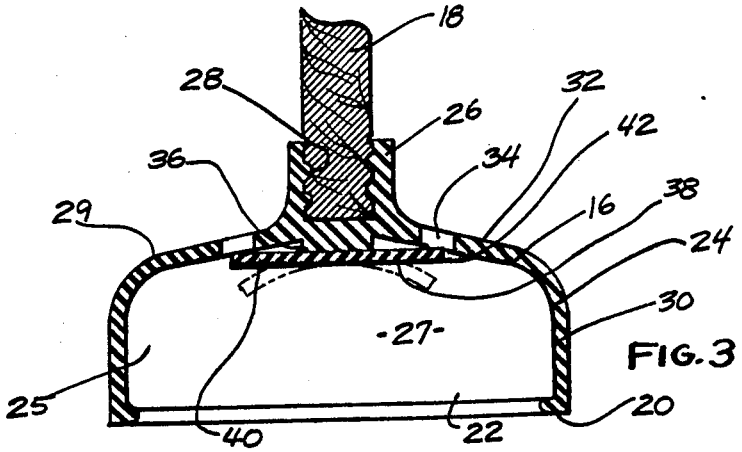
FIG. 3 is a side sectional view taken along section 3—3 as indicated in FIG. 2.
Figure 4:
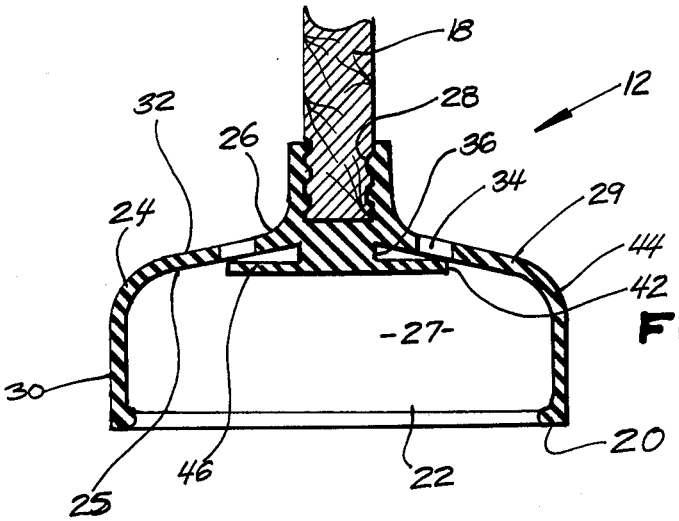
FIG. 4 is a side sectional as in FIG. 3, but showing an alternate embodiment.
Figure 5:
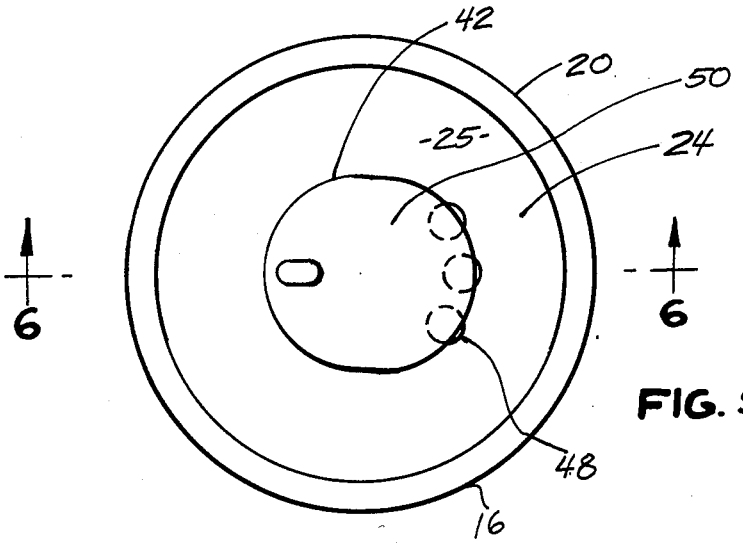
FIG. 5 is a bottom plan view of still another preferred embodiment of this invention.
Figure 6:
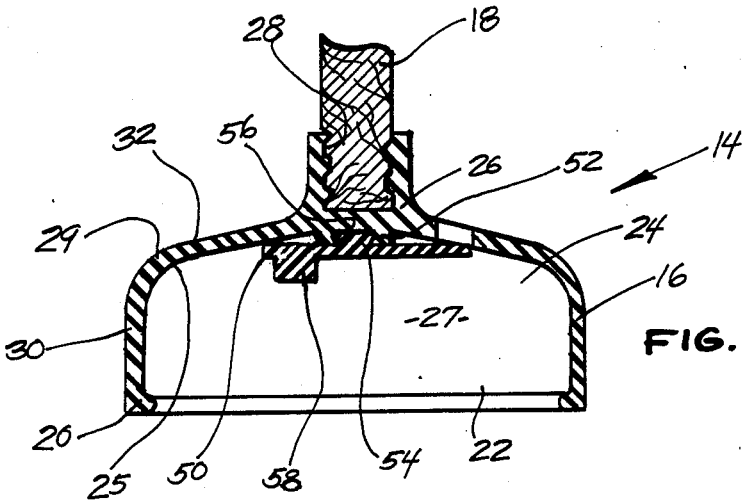
FIG. 6 is a side sectional of FIG. 5, taken along section 6—6 as indicated in FIG. 5.

The figures illustrate three different preferred embodiments of the improved plunger of this invention. FIGS. 1-3 show a plunger 10, FIG. 4 shows plunger 12, and FIGS. 5 and 6 show plunger 14. Most of the descriptions which follow will deal with the embodiments of FIGS. 1-3.

Plunger 10 includes a resiliently collapsible cup 16 and a driving handle member 18 attached thereto. Collapsible cup 16 has a lip 20 which defines a cup opening 22 at the lower end of cup 16. Lip 20 is formed at the edge of a wall 24 which forms cup 16.

Wall 24 extends from lip 20 to a cup upper end 26, where handle member 18 is attached. Wall 24 has a concave lower surface 25 forming a hollow space 27 within cup 16. Handle 18, which extends upwardly from the convex upper surface of wall 24, is attached by threaded engagement with a handle-receiving socket 28 formed in upper end 26 of cup 16. Other common attachment means may be used instead.

Cup wall 24 preferably includes an upwardly-extending portion 30 and a radially-extending portion 32. In some preferred embodiments, wall 24 is gradually curved so that there may be no clear dividing line between the upward and radial portions 30 and 32.

A number of apertures 34 extend through wall 24, in the radially-extending portion 32 thereof. Apertures 34 are circular, of equal size, and equidistant from the axis defined by plunger 10. As illustrated in FIG. 2, apertures 34 are near the axis, but at a point beyond the radius of handle 18. Apertures 34 together provide a substantial cross-section to accommodate flow of liquid through wall 24.

A raised portion or hub 36, as illustrated in FIG. 3, is integrally formed with wall 24 at a central, axially-aligned position. Mounted to hub 36 is a thin circular diaphragm 38, which has movable edge portions 40 terminating in a circular edge 42. Diaphragm 38 may be made of a somewhat flexible sealing web of water-impermeable material.

Hub 36 has an axial dimension sufficient to space diaphagm 38 from lower surface 25 of wall 24, but small enough to allow edge portions 40 of diaphragm 38 to be seated against apertures 34. This feature facilitates operation of the plunger by reducing or eliminating any adhesion between diaphragm 38 and lower surface 25 of cup 16.

Diaphragm 38 is dimensioned such that its edge 42 crosses apertures 34 in a manner allowing edge portions 40 of diaphragm 38 to overlie a major portion of each of the apertures 34. When diaphragm is in the seated position, shown by the solid lines in FIG. 3, it occludes about two-thirds or three-fourths of each of the apertures 34. When diaphragm 38 is in the unseated position, illustrated by the phantom lines in FIG. 3, it does not occlude apertures 34.

The partially occluding seated position is the position taken when plunger 10 is applying a driving downward force in which cup 16 is collapsing. The unseated position is the position taken when plunger 10 is undergoing upward motion as cup 16 reassumes its normal shape between the downward driving strokes.

In operation, the partial occlusion of apertures 34 during the downward strokes allows application of substantial hydraulic pressure to the clog. During such motion, of course, the bowl or basin is filled with water so cup 16 is submerged, and lip 20 is sealingly engaged to the bowl or basin around the drain.

During the downward stroke and the collapse of cup 16, the increased pressure within hollow space 27 and the limited flow of water through the occluded apertures keeps diaphragm 38 in the seated position. During the upward stroke the pressure within hollow space 27 is reduced with respect to the surrounding water and water flows through apertures 34 in a downward direction. Such pressure differential and such flow quickly move diaphragm edge portion 40 to the unseated position with respect to apertures 34.

FIG. 4 shows a cup member 44 and diaphragm 46 which are functionally similar to those in the embodiment of FIGS. 1–3. However, in this embodiment the diaphragm and cup are integrally formed. The thinness of the web which forms diaphragm 46 facilitates integral formation of the two parts, for example, by a molding process. This embodiment has the obvious advantage of even more simplicity in manufacture.

In FIGS. 5 and 6, the partial occlusion means is adjustable. Apertures 48 are arranged in one 180 degree arc around the axis of plunger 14. A circular diaphragm 50 is rotatably engaged with hub member 52. Formed with diaphragm 50 is a male engagement member 54 which is inserted into female engagement member 56 on hub 52. Male engagement member 54 is off-center with respect to circular diaphragm 50.

This eccentric mount causes diaphragm 50 to partially cover apertures 48 in varying degrees, depending on the rotational position of diaphragm 50. A nub 58 extends from the lower surface of diaphragm 50 at one radial position. Nub 58 aids in manual adjustment of the rotational position of diaphragm 50.

It may be desirable to increase the extent of partial occlusion of apertures 48 in order to maximize the downward hydraulic pressure for a given amount of force applied to the handle. On the other hand, it may be desirable to decrease the extent of partial occlusion of apertures 48 in order to provide a greater degree of control in the application of hydraulic force to the clog.

A variety of other structures may be used to achieve adjustability of the degree of partial occlusion.

The partial occlusion member may be in forms other than the preferred diaphragm. The partial occlusion member must be capable of moving between seated and unseated positions with respect to a portion of an aperture or portions or apertures to achieve the desired functioning. The apertures may take on a variety of shapes and sizes and numbers.

Cup 16 may be made of a variety of natural and synthetic elastomeric materials, including rubber and neoprene. The diaphragm may be made of a variety of materials, including fabric sheet material which is coated or otherwise treated with elastomeric material. Of course, when the diaphragm and cup are integrally formed, they will be of the same material. Handle 18 is preferably made of wood or other material.

The diaphragm may be generally planar as illustrated in the drawings or may be otherwise configured to conform more or less to the underside of the cup member.

The invention may be embodied in plungers of the common simple shape as illustrated, or may be embodied in plungers of more complex shape or design, including plungers with radially-inwardly extending lips and or additional flexible parts.

While the principles of this invention have been described in connection with specific embodiments, it should be understood clearly that these descriptions are made only by way of example and are not intended to limit the scope of this invention.

What is claimed is:

1. In a plunger for clearing clogged bathroom drains and the like of the type having a resiliently collapsible cap with a lip at its open lower end and a wall with an upper surface and a generally concave lower surface extending from the lip to an upper end, and a driving handle member attached thereto, the improvement comprising:

aperture means in the wall of the cup extending from the lower surface to space above the upper surface to permit flow of liquid therethrough at all times; and flexible partial occlusion means on the lower surface and secured to the cup, said occlusion means deformably movable, in response to pressure differentials, between a seated position partially occluding the aperture means and thereby permitting limited flow therethrough and an unseated position further opening the aperture means and thereby allowing substantially increased flow therethrough.

2. The plunger of claim 1 wherein the partial occlusion means is diaphragm means along the lower surface, secured to the cup adjacent to the aperture means, and having a free edge portion overlying a major portion of said aperture means.

3. The plunger of claim 2 wherein the lower surface has a raised portion adjacent to the aperture means, said diaphragm means being secured thereto, whereby the diaphragm means is spaced from the lower surface to facilitate diaphragm movement.

4. The plunger of claim 1 wherein the aperture means comprises a plurality of apertures arranged around and spaced from the axis of the cup.

5. The plunger of claim 4 wherein the diaphragm means comprises a diaphragm attached to the cup of an axial point of attachment and extending radially therefrom to terminate in an annular free edge crossing said apertures.

6. The plunger of claim 5 wherein the lower surface has a centrally located raised portion, said diaphragm being secured thereto, whereby the diaphragm is spaced from the lower surface to facilitate diaphragm movement.

7. The plunger of claim 1 wherein the aperture means comprises a plurality of apertures around and substantially equidistant from the axis of the cup.

8. The plunger of claim 7 wherein the diaphragm means comprises a diaphragm attached to the cup at an axial point of attachment and extending radially therefrom to terminate in an annular free edge crossing said apertures.

9. The plunger of claim 8 wherein the lower surface has a centrally located raised portion, said diaphragm being secured thereto, whereby the diaphragm is spaced from the lower surface to facilitate diaphragm movement.

10. The plunger of claim 8 wherein the diaphragm is substantially circular in shape and overlies substantially equal portions of each of the apertures.

11. The plunger of claim 10 wherein the lower surface has a centrally located raised portion, said diaphragm being secured thereto, whereby the diaphragm is spaced from the lower surface to facilitate diaphragm movement.

12. The plunger of claim 1 wherein the partial occlusion means comprises a diaphragm adjustably mounted to the cup such that the extent of partial occlusion can be adjusted.

13. The plunger of claim 12 wherein the aperture means comprises an array of apertures arranged unequally around the axis of the cup, and the diaphragm is rotatably mounted with respect to such array, such that rotating the diaphragm with respect to the cup varies the extent of partial occlusion of the apertures.

14. The plunger of claim 13 wherein the diaphragm is substantially circular and is mounted for eccentric rotation about the axis of the plunger.

15. The plunger of claim 14 wherein the lower surface has a centrally located raised portion, said diaphragm being secured thereto, whereby the diaphragm is spaced from the lower surface to facilitate diaphragm movement.

16. The plunger of claim 1 wherein the wall has upwardly-extending and radially-extending portions, said aperture means being through said radially-extending portion.

17. The plunger of claim 16 wherein the aperture means comprises a plurality of apertures arranged around and spaced from the axis of the cup.

18. The plunger of claim 17 wherein the diaphragm means comprises a diaphragm attached to the cup at an axial point of attachment and extending radially therefrom to terminate in an annular free edge crossing said apertures.

19. The plunger of claim 18 wherein the lower surface has a centrally located raised portion, said diaphragm being secured thereto, whereby the diaphragm is spaced from the lower surface to facilitate diaphragm movement.

20. The plunger of claim 1 wherein the diaphragm means and cup are integrally formed.

* * * * *